US008393061B2

(12) United States Patent
McGlynn

(10) Patent No.: US 8,393,061 B2
(45) Date of Patent: Mar. 12, 2013

(54) SEAT BELT SAFETY DEVICE

(76) Inventor: William McGlynn, Farmingdale, NY (US)

( * ) Notice: Subject to any disclaimer, the term of this patent is extended or adjusted under 35 U.S.C. 154(b) by 269 days.

(21) Appl. No.: 12/806,563

(22) Filed: Aug. 16, 2010

(65) Prior Publication Data

US 2012/0036687 A1 Feb. 16, 2012

(51) Int. Cl.
*A44B 11/25* (2006.01)

(52) U.S. Cl. ..... 24/633; 24/579.11; 24/198

(58) Field of Classification Search ..... 24/633, 24/579.11, 198
See application file for complete search history.

(56) References Cited

U.S. PATENT DOCUMENTS

| | | | | |
|---|---|---|---|---|
| 3,484,908 | A | 12/1969 | Lamb | |
| 4,497,094 | A * | 2/1985 | Morris | 24/633 |
| 4,502,194 | A | 3/1985 | Morris et al. | |
| 4,624,033 | A | 11/1986 | Orton | |
| 4,674,303 | A | 6/1987 | Salcone, II | |
| 4,675,954 | A | 6/1987 | Gullickson | |
| 4,731,912 | A | 3/1988 | Boriskie et al. | |
| 4,878,277 | A | 11/1989 | Portuese | |
| 4,939,824 | A | 7/1990 | Reed | |
| 4,961,251 | A | 10/1990 | Smith | |
| 4,987,662 | A | 1/1991 | Haffey et al. | |
| 5,052,087 | A | 10/1991 | Portuese | |
| 5,189,767 | A | 3/1993 | Reitsma | |
| 5,307,544 | A | 5/1994 | Quarberg et al. | |
| D358,246 | S | 5/1995 | Bacchiocchi et al. | |
| 5,442,840 | A | 8/1995 | Ewald | |
| D396,736 | S | 8/1998 | Davis | |
| 6,041,480 | A | 3/2000 | White | |
| 6,105,219 | A | 8/2000 | Beadle | |
| 6,138,331 | A | 10/2000 | Powers | |
| 6,431,652 | B1 | 8/2002 | Kennedy | |
| 6,463,637 | B1 * | 10/2002 | Carnahan | 24/578.15 |

(Continued)

FOREIGN PATENT DOCUMENTS

| | | |
|---|---|---|
| DE | 10304712 | 8/2004 |
| GB | 2307505 | 5/1997 |

(Continued)

*Primary Examiner* — Robert J Sandy
*Assistant Examiner* — Abigail E Morrell
(74) *Attorney, Agent, or Firm* — John F. Vodopia

(57) ABSTRACT

A seat belt safety device is configured to prevent access to a release button located on a side of a seat belt housing opposite a housing side at which a first seat belt segment is affixed and proximate a housing slot for receiving a tongue latch affixed to a second seat belt segment, which tongue latch is inserted in the housing slot to securely latch the first seat belt segment to the second seat belt segment. The seat belt safety device includes a first substantially planar member including a slot opening for receiving the tongue latch of the second seat belt segment and a limited access opening, substantially centered and proximate the slot opening so that when a tongue latch is inserted through the slot opening into the housing slot to latch and secure the first seat belt segment with the second seat belt segment, the limited access opening is located proximate the release button. A second substantially planar member attached to at least one edge of the first substantially planar member to extend at about 90° from a point of attachment so that when the tongue latch is inserted through the slot opening into the housing slot to latch, the second substantially planar member contacts to lay substantially flat against a portion of an outer horizontal surface of the seat belt housing such that the seat belt safety device is substantially immobilized.

7 Claims, 7 Drawing Sheets

U.S. PATENT DOCUMENTS

| | | | | |
|---|---|---|---|---|
| 6,694,578 | B1 | 2/2004 | Nicoll | |
| 6,769,157 | B1 | 8/2004 | Meal | |
| 6,988,297 | B2 * | 1/2006 | Willard et al. | 24/633 |
| 7,243,403 | B2 | 7/2007 | Hoffman | |
| 2005/0204523 | A1 * | 9/2005 | Smith | 24/633 |
| 2006/0196020 | A1 * | 9/2006 | Symns | 24/633 |
| 2007/0101558 | A1 * | 5/2007 | Marinkovic | 24/633 |
| 2008/0179936 | A1 | 7/2008 | Mirmikidis | |

FOREIGN PATENT DOCUMENTS

| | | |
|---|---|---|
| GB | 2348460 | 10/2000 |
| GB | 2371830 | 8/2010 |

* cited by examiner

PRIOR ART

SEAT BELT SAFETY DEVICE

BACKGROUND OF THE INVENTION

The present invention broadly relates to seat belt safety and, more particularly relates to a safety device that is used with a conventional seat belt apparatus to prevent small children or persons with impaired cognitive ability from accessing a push button release to unlock the seat belt.

Known automobile seat belts include a latch housing fixed to one seat belt segment, and a latch tongue fixed to the other seat belt segments. The latch tongue typically includes a latching aperture through which a locking element passes. During operation, a passenger is seated, the two belt segments are brought together to surround the seated passenger and the latch tongue is inserted into the latch housing. The insertion causes a locking member to extend into and become fixed within the latching aperture, securely connecting the two seat belt segments thereby securing the passenger in the seat.

To release and unfasten the locked seat belt, i.e., disengage the latch; a spring loaded release button is included in the buckle (latch) housing. The latch release button is located either on the side of the housing into which the tongue is inserted, or located on a horizontal housing surface that is substantially parallel to the insertion direction. Upon actuating the release button through application of a sufficient force, the locking member is extracted from the tongue aperture thereby releasing the latch. Releasing the latch allows for the tongue to disengage from the buckle housing, thereby separating the seat belt segments to release the passenger.

While the seat belt release button access is convenient for adult passengers, it may be dangerous for small children thought to be safely secured after latching, typically by an adult parent or guardian. That is, small children learn very soon the function of the seat belt release button and have the ability, at a very early age, to depress the release button and release them from the seat belt. Doing so not only puts them at a safety risk in case of a collision, but also allows them to stand up or climb throughout the automobile cabin. For matter, cognitively impaired older children and adults also may release seat belts or other safety harnesses employing push button release buckle holding mechanisms at inappropriate times.

In order to overcome this problem, various seat belt safety devices are known that attempt to prevent or limit access to seat belt buckle release buttons.

For example, U.S. Pat. No. 4,502,194 (the '194 patent) discloses a child proof automobile seat belt. The seat belt includes a latch tongue with a latching aperture fixed to one seat belt segment and a latch housing fixed to the other seat belt segment. The latch housing has a recess and opening at its distal end to receive the latch tongue, which tongue is automatically latched within the housing by insertion. The tongue is released by depressing a release button through an opening in the top face of the latch housing. A safety cover sleeve designed to be slipped over the latch housing is configured with one end partially closed to pass the latch tongue and with a small opening that overlies the release button.

The sleeve is retained in enclosing position on the housing by the latch tongue, whereafter a key or other tool can be inserted into the hole to press and release the button. But while the inventive sleeve does limit access, it appears to be intended for operation with side located release button. Also, the sleeve is designed as a second housing, which is cumbersome, and bulky, and tends to slip up the belt on the tongue side.

U.S. Pat. No. 4,987,662 (the '662 patent) discloses a seat belt release guard for use with a seat belt assembly in which the seat belt includes a latch plate on one free seat belt end and a latch plate receiving buckle assembly on the other free seat belt end. The latch plate receiving buckle assembly includes a spring release member thereon. The release guard comprises a buckle assembly receiving component and a cover component hingedly secured to adjacent one end of the receiving component and moveable in an arc parallel to the longitudinal axis of the release guard, from an open, unguarded buckle release position to a closed, guarded position detachably covering the associated spring release member against inadvertent access.

The release guard further comprises means to detachably latch the cover component to the receiving component when in the closed position, means to selectively release the cover component from the release component to move the cover component to the open unguarded position and means to detachably secure the release guard to the associated buckle assembly. But like the '194 patent, the '662 patent hinged cover is cumbersome, and bulky, as it completely covers the seat belt mechanism.

U.S. Pat. No. 6,988,297 (the '297 patent) discloses a security cover for a belt-type passive restraint system. The security cover includes a buckle with a tab selectively received in a tab receiver. The tab receiver includes a release button for releasing the tab whereby the passive restraint system is opened. The security cover includes a slot for receiving the tab and a keyhole located thereover for passing a key to the release button for releasing same. The keyhole is generally aligned with the release button with said receiver positioned in the enclosure, and a retainer selectively connected to the cover and to one of the receiver and the second belt. The retainer selectively retains the receiver within the cover enclosure. An optional restraint assembly can be provided for retaining the security cover on the belt receiver. In any of the embodiments, the housing is cumbersome, and bulky, and being that connections must be made with the housing, the guard is difficult to use.

U.S. Pat. No. 5,307,544 (the '544 patent) discloses a seat belt buckle guard comprising a one-piece, molded plastic, box-like enclosure. The enclosure includes one open end and an opposite end wall with a slot. A seat belt buckle fits through the open end into the enclosure and includes a latch plate receiving slot aligned with the slot in the housing. The latch plate on one belt half is inserted through the housing slot to mate with the buckle. An opening is formed in the top wall and the end wall for gaining access to the buckle release button. In one arrangement, the opening is a narrow slot through which a flat object, such as a key, can be inserted to operate the buckle's release button.

Alternatively, the opening is a circular aperture of a size permitting one's finger to be inserted to operate the release button. That is, the opening is surrounded by a tubular stub or neck that is threaded on its exterior to receive a child-resistant safety cap of the type commonly used on medicine bottles. When the cap is removed, exposing the opening, a finger can be inserted to activate the release button. Alternatively, the unit can be separated by folding along the hinge to allow actuation of a lever-type release or to gain access to a release button disposed on a front end edge of the buckle receptacle. In any of the embodiments, the housing is cumbersome, and bulky, and being that connections must be made with the housing, the guard is difficult to use.

SUMMARY OF THE INVENTION

The present invention provides The invention comprises a simple mechanical device that when used in cooperation with a conventional seat belt locking mechanism, prevents a child or mentally challenged adult from being able to access the push button on the mechanism housing to unlock the locked seat belt.

In one embodiment, the invention includes a seat belt safety device configured to prevent access to a release button located on a side of a seat belt housing opposite a housing side at which a first seat belt segment is affixed and proximate a housing slot for receiving a tongue latch affixed to a second seat belt segment, which tongue latch is inserted in the housing slot to securely latch the first seat belt segment to the second seat belt segment.

The seat belt safety device comprises a first substantially planar member including a slot opening for receiving the tongue latch of the second seat belt segment and a limited access opening, substantially centered and proximate the slot opening so that when a tongue latch is inserted through the slot opening into the housing slot to latch and secure the first seat belt segment with the second seat belt segment, the limited access opening is located proximate the release button.

A second substantially planar member attached to at least one edge of the first substantially planar member to extend at about 90° from a point of attachment so that when the tongue latch is inserted through the slot opening into the housing slot to latch, the second substantially planar member contacts to lay substantially flat against a portion of an outer horizontal surface of the seat belt housing such that the seat belt safety device is substantially immobilized.

In another embodiment, the invention includes a seat belt safety device configured to prevent access to a release button located on an exposed surface of a seat belt housing substantially perpendicular to a housing side at which a first seat belt segment is affixed in a housing slot for receiving a tongue latch affixed to a second seat belt segment, which tongue latch is inserted in the housing slot to securely latch the first seat belt segment to the second seat belt segment.

The seat belt safety device comprises a first substantially planar member including a slot opening for receiving the tongue latch of the second seat belt segment and a second substantially planar member attached to at least one edge of the first substantially planar member to extend at about 90° from a point of attachment so that when the tongue latch is inserted through the slot opening into the housing slot to latch, the second substantially planar member and contacts to lay substantially flat against a portion of an outer surface of the seat belt housing such that the seat belt safety device is substantially immobilized. The second substantially planar member includes a limited access opening, substantially centered and proximate the release button in the exposed surface of a seat belt housing so that when a tongue latch is inserted through the slot opening into the housing slot to latch and secure the first seat belt segment with the second seat belt segment.

In a third embodiment, the invention includes a seat belt safety device configured to prevent access to a release button located on an exposed surface of a seat belt housing substantially perpendicular to a housing side at which a first seat belt segment is affixed in a housing slot for receiving a tongue latch affixed to a second seat belt segment, which tongue latch is inserted in the housing slot to securely latch the first seat belt segment to the second seat belt segment.

The seat belt safety device comprises a first substantially planar member including a slot opening for receiving the tongue latch of the second seat belt segment. A second substantially planar member attached to at least one edge of the first substantially planar member to extend at about 90° from a point of attachment so that when the tongue latch is inserted through the slot opening into the housing slot to latch, the second substantially planar member and contacts to lay substantially flat against a portion of an outer surface of the seat belt housing such that the seat belt safety device is substantially immobilized.

The second substantially planar member includes a limited access opening, substantially centered and proximate the release button in the exposed surface of a seat belt housing so that when a tongue latch is inserted through the slot opening into the housing slot to latch and secure the first seat belt segment with the second seat belt segment. A release actuator mechanism mounted on the substantially planar member at the access opening location and comprising a rotating member and an extending member attached to the rotating member that is configured to advance, extending through the access opening when the rotated member is squeezed to overcome a locked position of a lock or detent element and rotated about a central axis as it is pressed down towards the planar member surface, and retracts back to a start position automatically when released.

BRIEF DESCRIPTION OF THE DRAWINGS

The present invention can best be understood in connection with the accompanying drawings. It is noted that the invention is not limited to the precise embodiments shown in drawings, in which.

DETAILED DESCRIPTION OF THE INVENTION

The following is a detailed description of example embodiments of the invention depicted in the accompanying drawings. The example embodiments are in such detail as to clearly communicate the invention and are designed to make such embodiments obvious to a person of ordinary skill in the art. However, the amount of detail offered is not intended to limit the anticipated variations of embodiments; on the contrary, the intention is to cover all modifications, equivalents, and alternatives falling within the spirit and scope of the present invention, as defined by the appended claims.

As mentioned above, the invention comprises a simple mechanical device that when used in cooperation with a conventional seat belt locking mechanism, with a push release button located on either the side or horizontal surface of the latch housing, prevents or limits an ability of a child or cognitively challenged person irrespective of age from being able to access the seat belt push release button in order to unlock the locked seat belt.

Figure 1A:
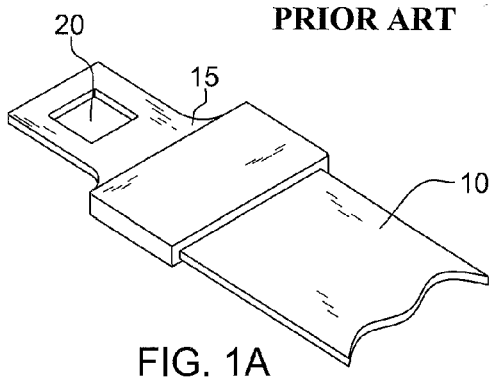
FIG. 1A PRIOR ART
FIG. 1A is a perspective view of a conventional seat belt tongue attached to one end of a seat belt segment.
Figure 1B:
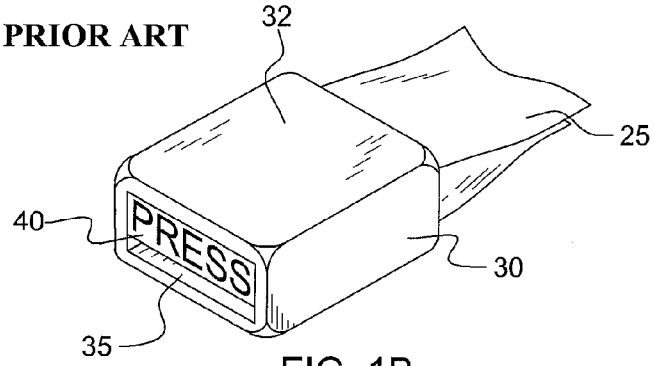
FIG. 1B PRIOR ART
FIG. 1B is a perspective view of a seat belt latch housing attached to one end of a seat belt segment and configured with a seat belt push release button on a housing side proximate a side slot for receiving a seat belt tongue.
Figure 1C:
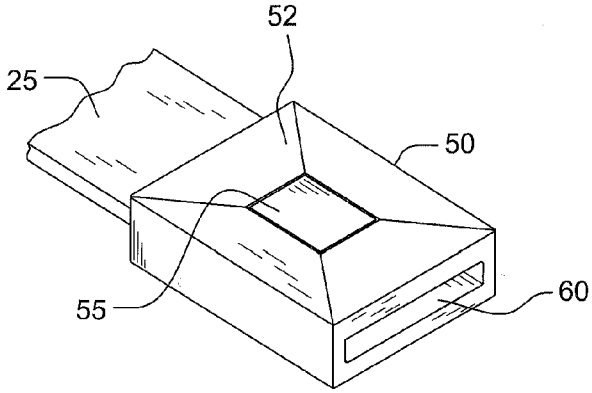
FIG. 1C is a perspective view of a seat belt latch housing attached to one end of a seat belt segment and configured with a seat belt push release button on a housing upper exposed surface, which surface is substantially perpendicular to a side surface that includes a side slot for receiving a seat belt tongue.

FIGS. 1A and 113 together depict a conventional seat belt locking or latching mechanism. That is, FIG. 1A depicts a latch tongue (15) affixed to one seat belt segment (10). Latch tongue (15) includes a latching aperture (20) for receiving a locking element (not shown) that is moved into the aperture when the latch tongue is inserted into the latch housing. FIG. 1B depicts a latch housing (30) fixed to another seat belt segment (25). The latch housing (30) includes a slot (35) or latch opening in a side of the housing opposite a side to which the seat belt element (25) is attached. A release button (40) is shown just above slot (35) that is pressed to release the seat belts from their locked state. FIG. 1C depicts a latch housing (50) fixed to another seat belt segment (25), which includes a slot (60) in a side of the housing opposite a side to which the seat belt element (25) is attached. A release button (55) is shown on a top surface of latch housing (50), which surface is parallel with the direction of motion for inserting a tongue latch (15) into the slot (60) on the housing side.

During operation, a passenger is seated in an automobile in which other ends of a seat belts segments (10) and (25) are affixed. The two belt segments (10, 25) to which tongue latch (15) and latch housings (30; 50) are attached are brought together to surround the seated passenger and the latch tongue (15) is inserted into the latch housing (30; 50). The insertion causes a locking member (not shown) to extend into and become fixed within the latching aperture (20), securely connecting the two seat belt segments (10; 25), thereby securing the passenger in the seat.

To release and unfasten the locked seat belt, i.e., to disengage the latch tongue (15), the release buttons (40; 55) comprise a spring loaded release mechanism in the respective latch housings (but not shown in the drawing figures). Upon actuating the release button (40; 55) through application of a sufficient pressing force, typically applied directly by a user's fingers, the locking member is extracted from the tongue aperture (20), thereby releasing the latch tongue (15) from its position in the housing (30; 50). The invention prevents or limits an ability of small children or individuals that may be cognitively impaired or otherwise challenged from readily accessing or otherwise actuating the release buttons (40, 55) and unlock or separate the complementary seat belt segments.

Figure 2B:
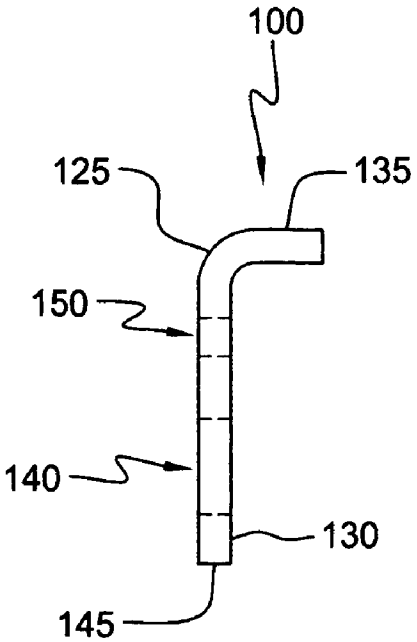
FIG. 2B is side plan view of the FIG. 2A embodiment.
Figure 2A:
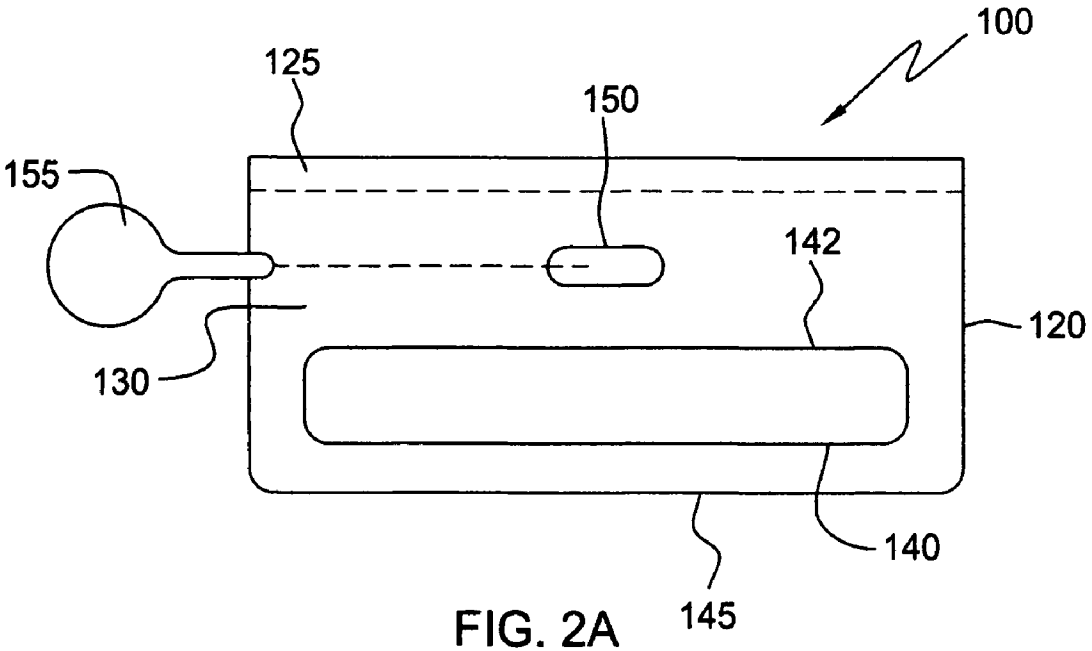
FIG. 2A is a top plan view of one embodiment of the seat belt safety device configured for operation with a seat belt latch housing depicted in FIG. 1B.

FIG. 2A shows a top plan view of one embodiment of the seat belt safety device (100) of the invention. FIG. 2B is a side view of the FIG. 2A seat belt safety device (100). As shown, seat belt safety device (100) comprises two substantially perpendicular planar members (130; 135). While the planar members may be formed as separate members, and joined, it is preferred that the device is configured from a 2"×3" single piece (or plate) of sheet-like material (120). The sheet-like plate may be molded, extruded or punched out of a larger plate or sheet of stainless steel, or other useable material.

The sheet-like material comprising plate (120) may be metal, hard plastic or like material, wood, etc., but is preferably stainless steel. The thickness may be varied in a range of between 1/64" and 1/4", but is preferably 1/16". Please note that the particular dimensions of the plate (120) are provided for exemplary purposes only, and may be varied to accommodate the dimensions of various seat belt locking mechanisms without deviating from the scope and spirit of the invention.

When formed from a single plate of sheet-like material, one longitudinal edge of the plate (120) is bent at a substantially 90° angle to form a first planar section (130) and a second planar section (135), separated by a bend or mutual edge (125). The first planar section (130) is about 2 1/4"×3;" the second planar section is about 3/8"×3". The bend or edge (125) extends for the entire 3" length. Please note that while the safety device (100) depicted in FIGS. 2A; 2B is formed of one solid sheet-like metal (2"×3") plate (120), for example, stainless steel, the invention is not limited thereto. The invention may be formed of any hardened shape-retaining material. For that matter, the invention includes that the first planar section (130) and second planar section (135) may be formed as separate flat pieces connected or attached by various means, i.e., welding.

A horizontal slot (140) is included in the first planar section (130), which is approximately 1/2" off an edge (145) that is opposite to the bend (125). The slot (140) is approximately 1/8" to 1/4" wide, but preferably 3/16". The slot (140) extends about 1 5/8" of the 3" length in parallel with edge (145) and the bend (125). The slot is preferably centered. In from an inner edge (142) of the slot (140) about 1/4" is an access opening (150) used to provide access to pressing means (155) for pressing a seat belt push button release (as described above).

Pressing means (155) may comprise without limitation a key, pin, screw driver, pen, pencil, etc. Access opening (150) is a hole or via in the first planar section (130) that is about 1/16" to 1/2" long and 1/16" to 1/4" wide, and preferably 3/8" long by 3/16" wide. Please note however, the specific dimensions disclosed are for exemplary purposes only, and are not meant to limit the invention in any way. The access opening may comprise any known shape, for example, instead of rectangular, it may be circular with a radius of between 1/16" and 3/8", and preferably 1/4". The size of access opening (150) only matters in that it must be large enough to allow insertion of the means for pressing (155) to actuate release by pressing seat belt release button (35), but not too large that a child or cognitively challenged person might be able to extend their finger in to actuate.

Figure 2C:
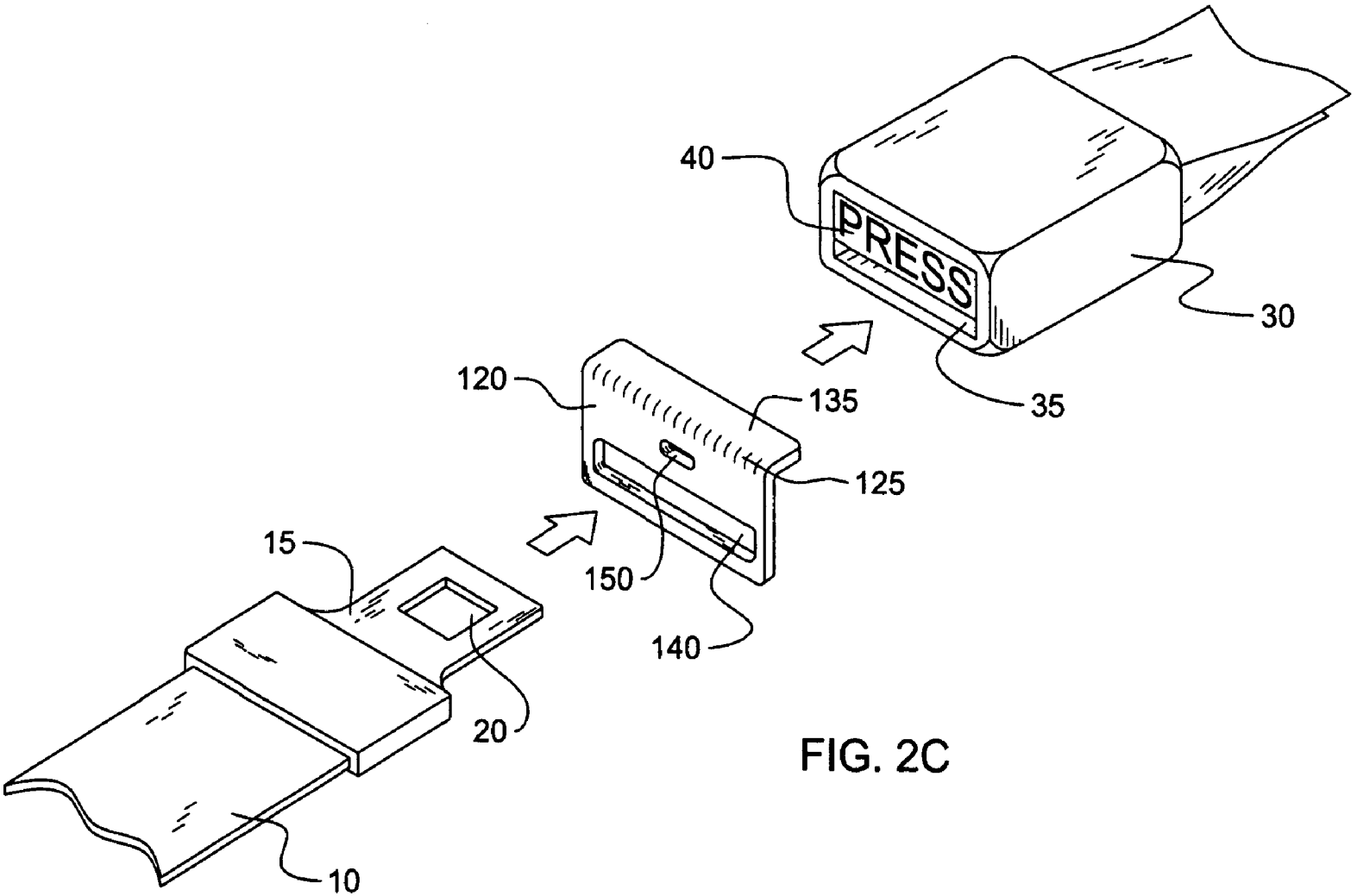
FIG. 2C is a perspective view of the seat belt safety device (100) of FIGS. 2A and 2B interposed between a seat belt tongue (15) and seat belt latch housing (30) in an exploded view to highlight device operation.

FIG. 2C depicts the operation of the seat belt safety device of FIGS. 2A, 2B. That is, the seat belt tongue (15) is inserted through the slot (140) in the first planar surface (130) from which the bend (125) turns forming the second planar surface (135), and then into the latch opening (35) in the locking mechanism housing (30). The orientation of the safety device (100) is such that the opening (150) is located proximate and above the push button release (35) and that an underside of the second planar surface (135) aligns with and contacts a planar or upper horizontal surface (32) of the latch housing (30), as shown.

When latched, there is very little leeway for movement of the safety device (100) off of the upper housing surface (32)

and off the underside of first planar surface (130) abutted against the housing side with slot (35). The underside of the first planar surface (130) and the underside of the second planar surface are aligned substantially co-planar with the top or exposed housing surface (32) and side with slot (35). This effectively prevents access to the push button (35), for example, by a finger, other than with pressing means (155) extended through the opening (150).

For that matter, while the flat plate of sheet like material (120) is initially rectangular, so that when bent the first and second planar sections also are rectangular, the safety device (100) is not limited to a particular shape as long as it comprises two substantially flat surfaces to accommodate a access slot and access opening, and when arranged against a latch housing extending through the slot and latched, is substantially immobile preventing finger access to the access opening.

Figure 3B:
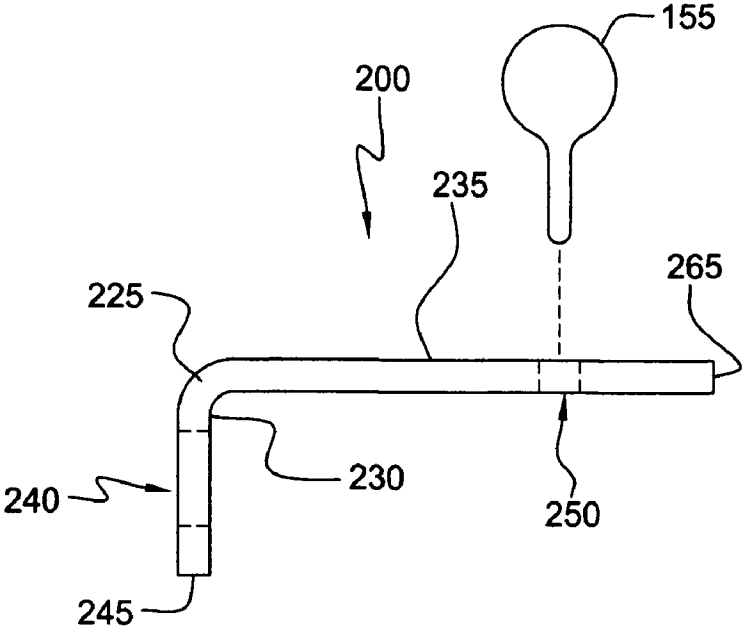
FIG. 3B is side plan view of the FIG. 3A embodiment.
Figure 3A:
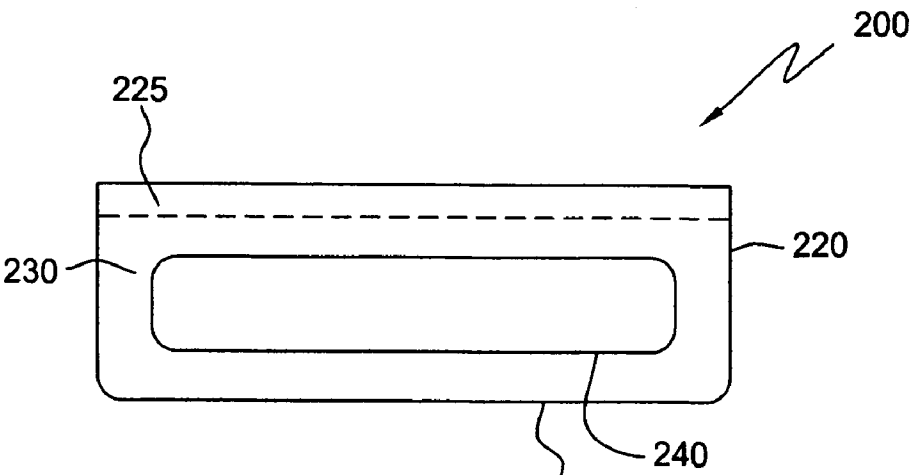
FIG. 3A is a top plan view of one embodiment of the seat belt safety device configured for operation with a seat belt latch housing depicted in FIG. 1C.

FIGS. 3A and 3B together depict an alternative embodiment of a seat belt safety device (200) of the invention, which is configured for use with a latch housing (50), as seen in FIG. 1C. FIG. 3A is a top plan view of seat belt safety device (200), and FIG. 3B is a side view. Seat belt safety device (200) may be configured from a 2"×3" piece or plate of sheet-like material (220), and bent, or may comprise two separate pieces joined at a substantially right angle. The material may comprise metal, hard plastic or like material, wood, etc., without limitation, but is preferably stainless steel. Please note that the particular dimensions of the plate (220) are provided for exemplary purposes only, and that its size and/or shape may be varied to accommodate the dimensions of various seat belt locking mechanisms, or the whim of the designer, without deviating from the scope and spirit of the invention.

In the embodiment shown, one longitudinal edge (225) of the plate (220) is bent at a substantially 90° angle to form a first planar section (230) and a second planar section (235) at a bend edge (225). The first planar section (230) is about 1¼"×3;" the second planar section is about 1⅝"×3". The bend edge (235) extends for the entire 3" length. Please note that while the safety device (200) depicted in FIGS. 3A; 3B is formed of one solid plate of sheet-like material (220), the invention is not limited thereto, but may be made of any available solid material. For that matter, the seat belt device may comprise two separate planar sections, first planar section (230) and second planar section (235), which are physically attached and made integral, and the actual dimensions of each of the planar sections may be varied to fit the latch housings for which it will be employed, or the whim of the designer, without deviating from the scope and spirit of the invention.

A horizontal slot (240) is included in the first planar section (230), which is approximately ½" off an edge (245) that is opposite to the bend edge (225). The slot (240) is approximately 1/16" to ¼" wide, but preferably 3/16" wide. The slot (240) extends about 1⅝" of the 3" length in parallel with edge (245) and the bend (225). The slot is preferably centered, and the length is only defined for exemplary purposed; the length, like the slot width, may be increased or decreased to accommodate the width of the tongue latch, or the whim of the designer. Between an outer edge (265) of second planar section (235) and bend edge (225), which is opposite from the outer edge, is an access opening (250) used to provide access to means (155) to be inserted and extend therethrough to press a push button release (55) of seat belt mechanism arranged on the top or upper horizontal surface of latch housing (50).

Access opening (250) is a hole or via in the first planar section (130) that is about 1/16" to ½" long and 1/16" to ¼" wide, and preferably ⅜" long by 3/16" wide. Please note however, the specific dimensions disclosed are for exemplary purposes only, and are not meant to limit the invention in any way. The access opening may comprise any known shape, for example, instead of rectangular, it may be circular with a radius of between 1/16" and ⅜", and preferably ¼". The size of access opening (250) only matters in that it must be large enough to allow insertion of the means for pressing (155) to actuate release by pressing seat belt release button (35), but not too large that a child or cognitively challenged person might be able to extend their finger in to actuate.

Figure 3C:
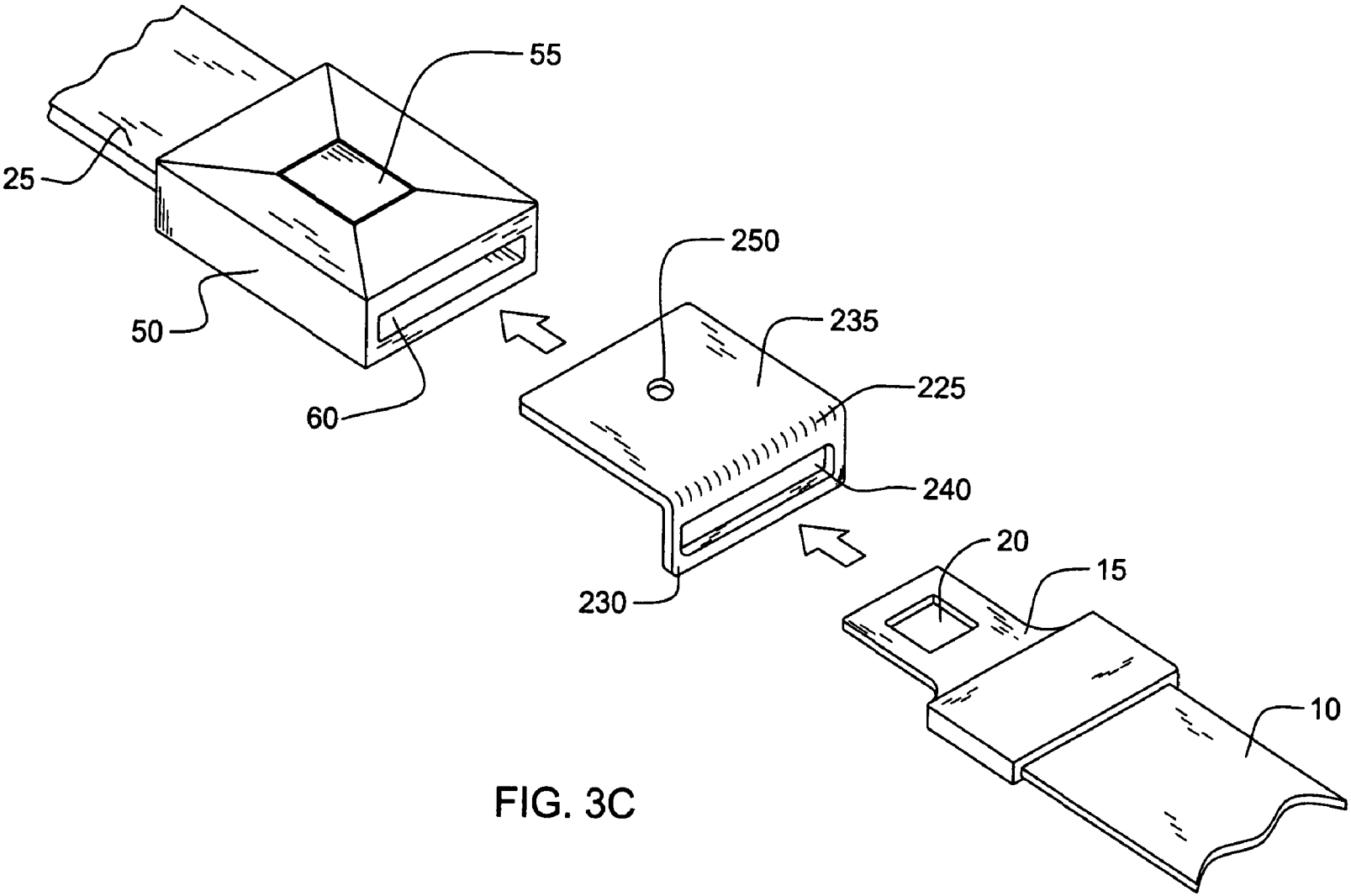
FIG. 3C is a perspective view of the seat belt safety device (200) of FIGS. 3A and 3B interposed between a seat belt tongue (15) and seat belt latch housing (30) in an exploded view to highlight device operation.

FIG. 3C depicts the operation of the seat belt safety device of FIGS. 3A, 3B. That is, the seat belt tongue (15) is inserted through the slot (240) in the first planar surface (230) from which the bend (225) turns, and then into the latch opening (60) in the locking mechanism housing (50). The orientation of the safety device (200) is such that the opening (250) is located proximate and above the push button release (55) and that an underside of the second planar surface (235) aligns with and contacts a planar or upper horizontal surface (52) of the buckle housing (50), as shown. When latched, there is very little leeway for movement of the safety device (200) off of the upper housing surface (52) and the underside of first planar surface (230) against the housing side with slot (60). This effectively prevents access (for example, by a finger) to the push button (55) other than by use of pressing means (155) extend through the access opening (250).

The above-described embodiments may be described as a seat belt safety device comprising a first substantially planar member with a pair of substantially parallel opposing edges along its length and a pair of substantially parallel opposing edges along its width; and a second substantially planar member attached and extending along one of the length-wise edges of the first planar member, and extending substantially perpendicularly a plane of the first planar member, wherein the first planar member includes a slot extending in parallel to the length-wise edge opposite the lengthwise edge to which the second planar member is attached and an opening, substantially centered, between the slot and the second planar member, for a latch housing with a side-located latch release button, or on the second substantially planar member for a latch housing with a seat belt latch release push button located on the top or exposed housing surface that is substantially perpendicular to the side with the housing slot.

Figure 4A:
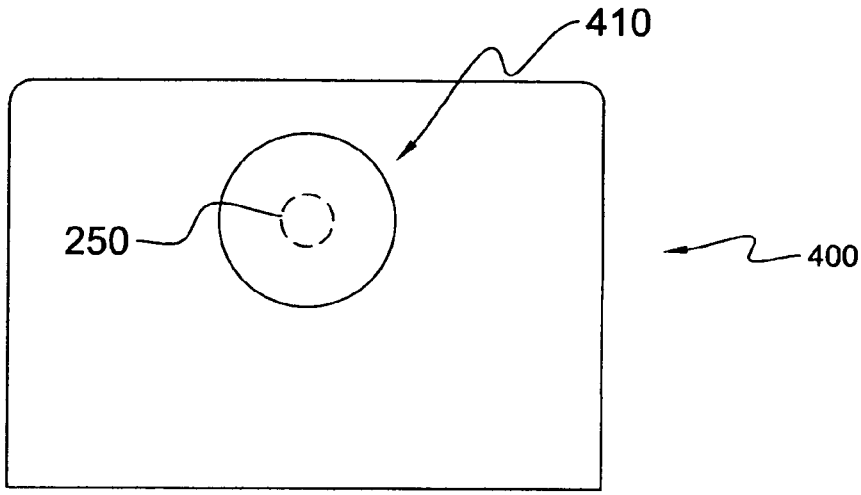
FIG. 4A is a top plan view of one embodiment of the seat belt safety device configured with a spring loaded release button actuator with arresting means limit operation by small children or cognitively challenged persons of a seat belt latch housing depicted in FIG. 1C.
Figure 4B:
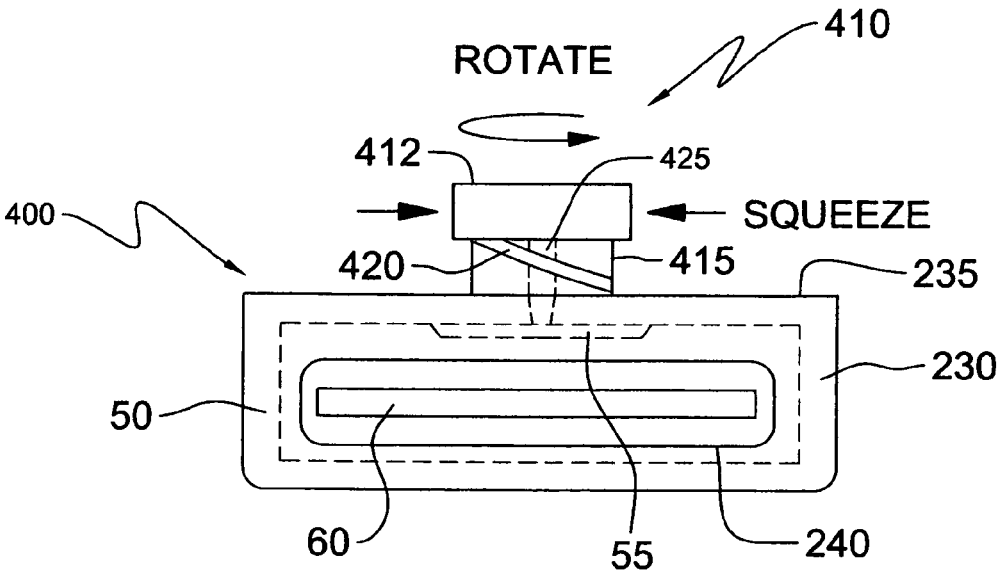
FIG. 4B is side plan view of the FIG. 4A embodiment.

FIGS. 4A and 4B together depict another embodiment of a seat belt safety device (400), which is quite similar in many respects to the embodiment of FIGS. 3A; 3B, but includes a spring loaded release button actuator (410) with arresting means provided under a gripping and pressing element (412), which limit seat belt release operation by small children or cognitively challenged persons of a seat belt latch housing depicted in FIG. 1B or 1C. That is, once the tongue element (15) is inserted through the opening (240) in the seat belt safety device (400) and then into latch opening (35, 60) of housings (30, 50), respectively, the release button actuator or pressing element (412) must be manipulated to enable depression and release or unlocking of the tongue (15) from a respective latch housing.

The gripping and pressing element (412) is arranged with one or more detent elements on an inside (not shown) that prevent it from moving axially unless squeezed inwardly towards the radial center a certain radial amount. Once sufficiently squeezed, the gripping and pressing element (412) is forced down as it rotates axially along path or track guide (420). Track (420) may be an indentation into a surface of cylindrical member (415), such as a groove, or may be an extrusion, such as a rail. A lock or detent element present on the inside of the pressing element (not shown) is allowed access to the track guide allowing downwards (and radial) movement only after squeezing to overcome the locked position in a groove track. As the detent element moves axially down, a pushing member (425) extends through access opening (250) and makes contact, and actuates release button (60) in housing (50), or release button (40) in a side mounted housing (30). In a case where the guide track is a raised rail, the detent element is replaced by a grove that upon release from a locked state by squeezing, rides the rail as the pushing member advances vertically.

The gripping and pressing element (412) is spring actuated, so that when the pressure is removed, it moves (and rotates) upwards and back to its locked position. If a user does not know how to operate the gripping and pressing element (412), in cooperation with the seat belt latch mechanism, they are unable to release or unlatch the seat belt. It should be noted that the particular means shown for preventing/allowing the pushing member (425) to contact and actuate the release button are for exemplary purposes only. Any means for locking/releasing the gripping and pressing element (412) that would act to hinder a child or mentally challenged person from readily pressing a release button to the skilled artisan, for example, a childproof pharmaceutical pill container, without deviating from the scope and spirit of the invention. Please further note that while the FIGS. 4A; 4B embodiment is shown arranged for use with a latch housing (50) configured with a top-positioned push button release (55), that the spring loaded release button actuator (410) may be implemented in a first planar section (130) of a seat belt safety device similar to the FIGS. 2A; 2B embodiment.

Figure 4C:
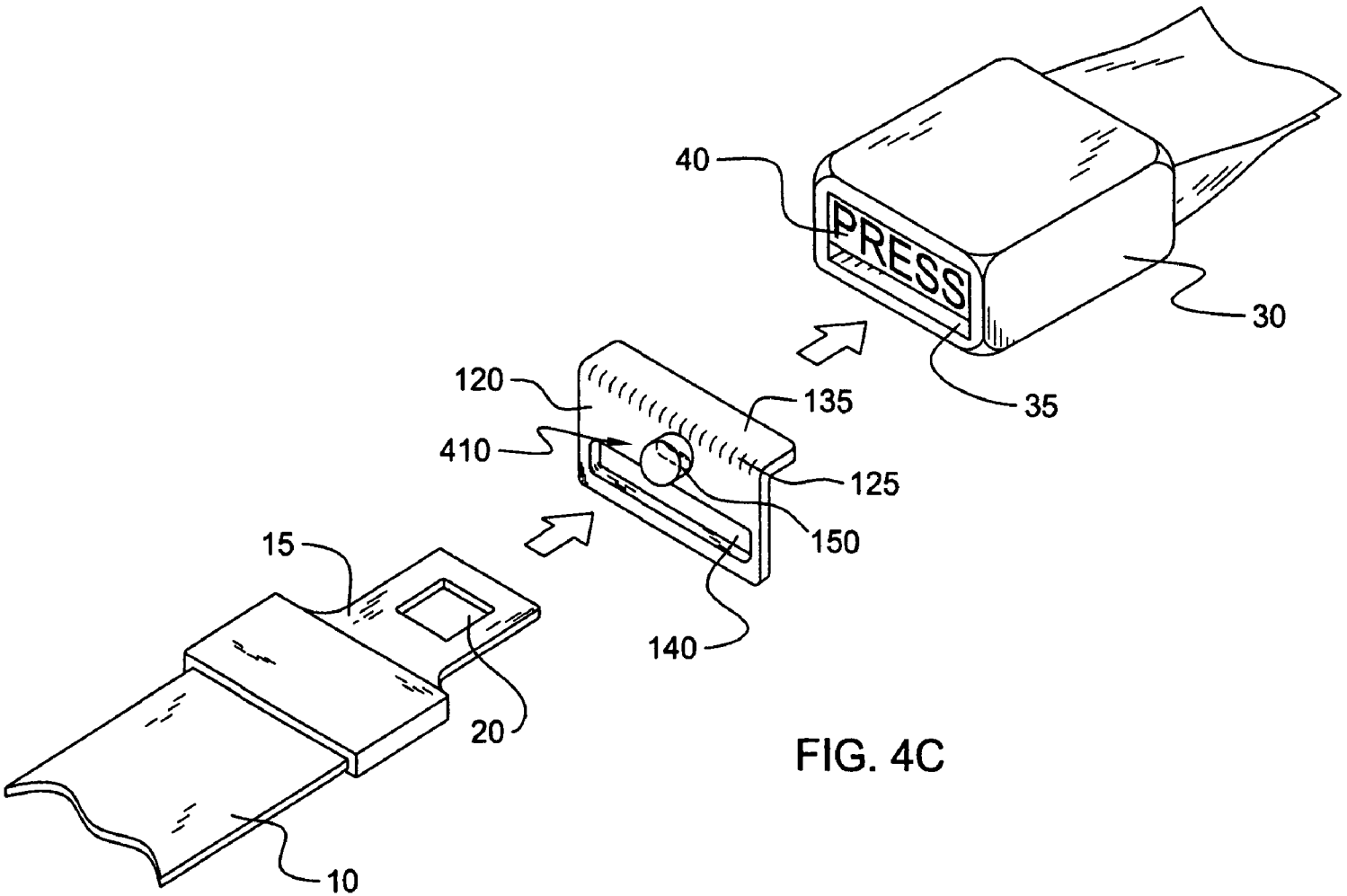
FIG. 4C is a perspective view of the a belt safety device (400) of FIGS. 4A and 4B interposed between a seat belt tongue (15) and seat belt latch housing (30) in an exploded view to highlight device operation.

FIG. 4C depicts the operation of the seat belt safety device of FIGS. 3A, 3B, modified such that the spring loaded release button actuator (410) is located on a side just above slot (140) so that tongue (15) may be inserted into an opening (35) of a housing (30). That is, the seat belt tongue (15) is inserted through the slot (140) in the first planar surface (130) from which the bend (125) turns, and then into the latch opening (35) in the locking mechanism housing (30). The orientation of the safety device (400) is such that the spring loaded release button actuator (410) is located proximate and above the push button release (40) and that an underside of the first planar surface (130) aligns with and contacts a planar or upper horizontal surface (32) of the buckle or latch housing (30), as shown. When latched, there is very little leeway for movement of the safety device (400) off of the upper housing surface (32) and the underside of first planar surface (130) against the housing side with slot (35). This effectively prevents access (for example, by a finger) to the push or press release button (40) other than by use of pressing means (425) extend through the access opening (150), as described.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended claims.

What is claimed is:

1. A seat belt safety device configured to prevent access to a release button located on a side of a seat belt housing opposite a housing side at which a first seat belt segment is affixed and proximate a housing slot for receiving a tongue latch affixed to a second seat belt segment, wherein the tongue latch is inserted in the housing slot to securely latch the first seat belt segment to the second seat belt segment, said seat belt safety device consisting of:

a first planar member formed in a rectangular shape and including a slot opening for receiving the tongue latch of the second seat belt segment and a limited access opening, substantially centered and proximate the slot opening so that when the tongue latch is inserted through the slot opening into the housing slot to latch and secure the first seat belt segment with the second seat belt segment, the limited access opening is located proximate the release button; and a second planar member formed in a rectangular shape and extending from a first edge of the first planar member in an "L" shaped arrangement such that a plane of the second planar member is perpendicular to a plane of the first planar member and such that when the tongue latch is inserted through the slot opening into the housing slot to latch, the second planar member contacts the seat belt housing to lie substantially flat against a portion of an outer horizontal surface of the seat belt housing substantially immobilizing the seat belt safety device, wherein the first and second planar members are formed from a single sheet of rigid material.

2. The seat belt safety device as set forth in claim 1, wherein the limited access opening is configured to permit through access of a tool for pressing the release button to release the tongue latch from the seat belt housing, wherein the tool for pressing is selected from the group consisting of a key, a pin, a screw driver, a pen and a pencil.

3. The seat belt safety device as set forth in claim 1, wherein the single sheet of rigid material is metal.

4. The seat belt safety device as set forth in claim 1, wherein the single sheet of rigid material is stainless steel.

5. The seat belt safety device as set forth in claim 1, wherein the single sheet of rigid material is stamped, and bent into the "L" shaped arrangement.

6. The seat belt safety device as set forth in claim 1, wherein the second planar member extends less than one inch onto and over the outer horizontal surface of the seat belt housing.

7. The seat belt safety device as set forth in claim 1, wherein the first planar member extends to a second edge opposite the first edge, wherein the second edge is less than one inch from and substantially in parallel with the slot opening.

* * * * *